United States Patent [19]

Leveille

[11] 4,095,533

[45] Jun. 20, 1978

[54] TRAYS COMBINABLE INTO AN ASSEMBLY

[76] Inventor: Jean Claude Leveille, No. I Tennis Court, Apt. 6G, Brooklyn, N.Y. 11226

[21] Appl. No.: 787,964

[22] Filed: Apr. 15, 1977

[51] Int. Cl.[2] ..... A47B 13/08; A47F 3/14

[52] U.S. Cl. ..... 108/90; 108/26; 211/132; 224/42.45 B

[58] Field of Search ..... 108/11, 90, 91, 26, 108/13, 18, 25, 27, 115, 111; 297/194; 211/126, 132; 224/29 R, 42.42 R, 42.42 A, 42.45 R, 42.45 B; 206/553, 562

[56] References Cited

U.S. PATENT DOCUMENTS

| | | | |
|---|---|---|---|
| 1,820,635 | 8/1931 | Strickland | 108/11 |
| 2,014,745 | 9/1935 | Regli | 108/11 |
| 2,682,950 | 7/1954 | Mercer et al. | 206/553 |
| 2,808,191 | 10/1957 | Cramer | 206/562 X |
| 2,826,469 | 3/1958 | Grant | 108/90 |
| 2,853,219 | 9/1958 | Schwartz | 224/42.45 B |
| 3,048,459 | 8/1962 | Moore | 108/90 |
| 3,282,230 | 11/1966 | Levy | 297/194 X |
| 3,311,276 | 3/1967 | Fromm | 224/29 R |
| 3,376,974 | 4/1968 | Hilliard | 206/553 X |
| 3,632,029 | 1/1972 | Sonner | 224/42.45 B |
| 3,675,969 | 7/1972 | Gage | 297/194 |
| 3,800,957 | 4/1974 | Krause | 211/132 |
| 3,851,754 | 12/1974 | Jones | 206/549 |
| 4,055,286 | 10/1977 | Schmid | 224/42.45 R |

*Primary Examiner*—James T. McCall

*Attorney, Agent, or Firm*—Robert E. Burns; Emmanuel J. Lobato; Bruce L. Adams

[57] ABSTRACT

A pair of portable trays usable separately and combined into a single tray. One of the trays is provided with a plurality of openings on the receptacle thereof for carrying articles such as ice cream cones thereon and has legs for converting it into a stand. The legs are provided with pockets for serving silverware and napkins therefrom. The other tray is a tray with a flat receptacle having raised edges and is free of openings but is provided on an underside thereof with two spaced lugs releasably insertable into aligned paired openings of the one tray for converting it into a conventional portable tray as well as a conventional tray on a stand.

3 Claims, 5 Drawing Figures

TRAYS COMBINABLE INTO AN ASSEMBLY

BACKGROUND OF THE INVENTION

This invention relates to trays and more particularly to two trays usable separately and combined into a single tray and stand combination.

Trays are used extensively for easily transporting foods thereon and serving them. These trays generally are simply flat receptacles on which the articles to be served are carried. Napkins and silverware are generally placed on the tray along with the articles to be served therefrom. In the event that the food to be served is ice cream cones they cannot be carried on a conventional tray.

SUMMARY OF THE INVENTION

It is an object of the present invention to provide a tray for serving ice cream cones and with foldable legs for converting it into a stand and a flat tray for converting the stand into a conventional tray and stand.

According to the invention two separate trays usable separately are releasably joinable into a tray and stand combination. A first tray has a flat receptacle having a plurality of holes for receiving articles such as ice cream cones therein for serving therefrom. The holes are dimensioned for holding different sizes and configurations of ice cream cones.

The flat receptacle is provided with two elongated legs hinged on the flat receptacle. The legs are positionable in a folded position against the underside of the receptacle and are movable to an extended or depending position for converting the first tray to a stand. The legs have pockets for serving silverware and napkins therefrom. A second flat tray has a receptacle free of holes and has raised edges. Two locating lugs are provided on an underside thereof which are releasably received into aligned holes of the first tray for locating and releasably mounting the second tray on the first tray receptacle to convert it into a flat tray free of holes for transporting articles thereon.

BRIEF DESCRIPTION OF THE DRAWINGS

Other objects and advantages of the trays in accordance with the invention will appear from the following description of an example of the invention and the novel features are particularly pointed out in the appended claims and drawings in which:

DESCRIPTION OF THE PREFERRED EMBODIMENTS

Figure 1:
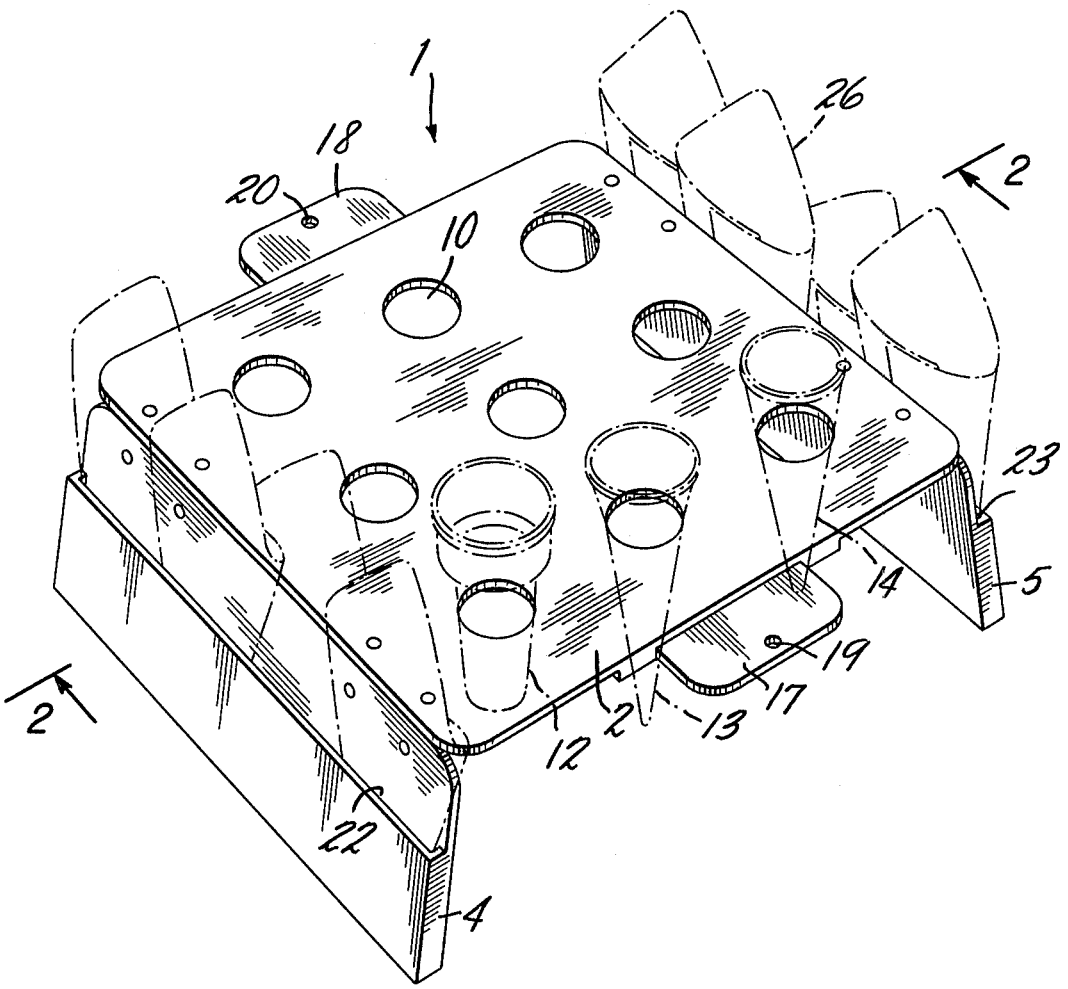
FIG. 1 is a perspective view of a tray according to the invention convertible into a stand.
Figure 2:
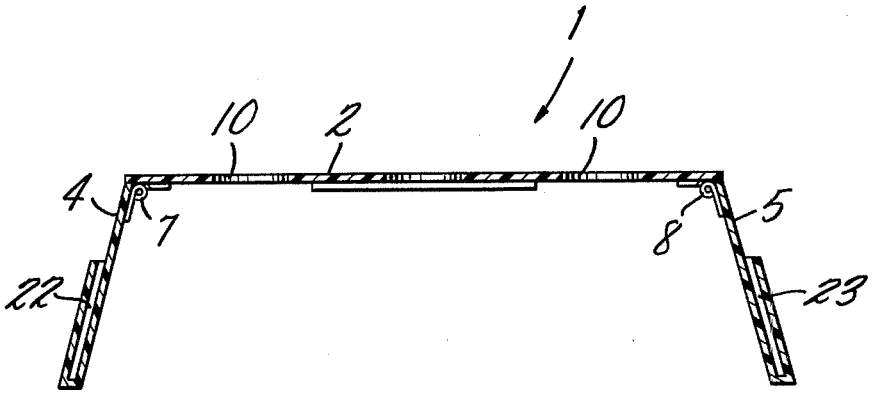
FIG. 2 is a cross section view taken along section line 2 — 2 of FIG. 1.

A tray 1 according to the invention is illustrated in FIG. 1. It comprises a flat receptacle 2 provided at opposite ends with elongated legs 4, 5 made of the same material as the receptacle 2. These legs are hinged to the receptacle by hinges 7, 8 and can be folded against an underside of the receptacle 2 or extended in a downward or depending position as illustrated in FIG. 2 to convert the tray to a stand.

The receptacle 2 is provided with a plurality of through holes 10 that receive articles carried therein, for example different sizes and types of ice cream cones 12, 13, 14. The holes are dimensioned to a common dimension selected for the various type cones. The tray is transportable and the receptacle is provided with handles 17, 18 each of which has an opening 19, 20 for hanging the tray when not in use.

Figure 3:
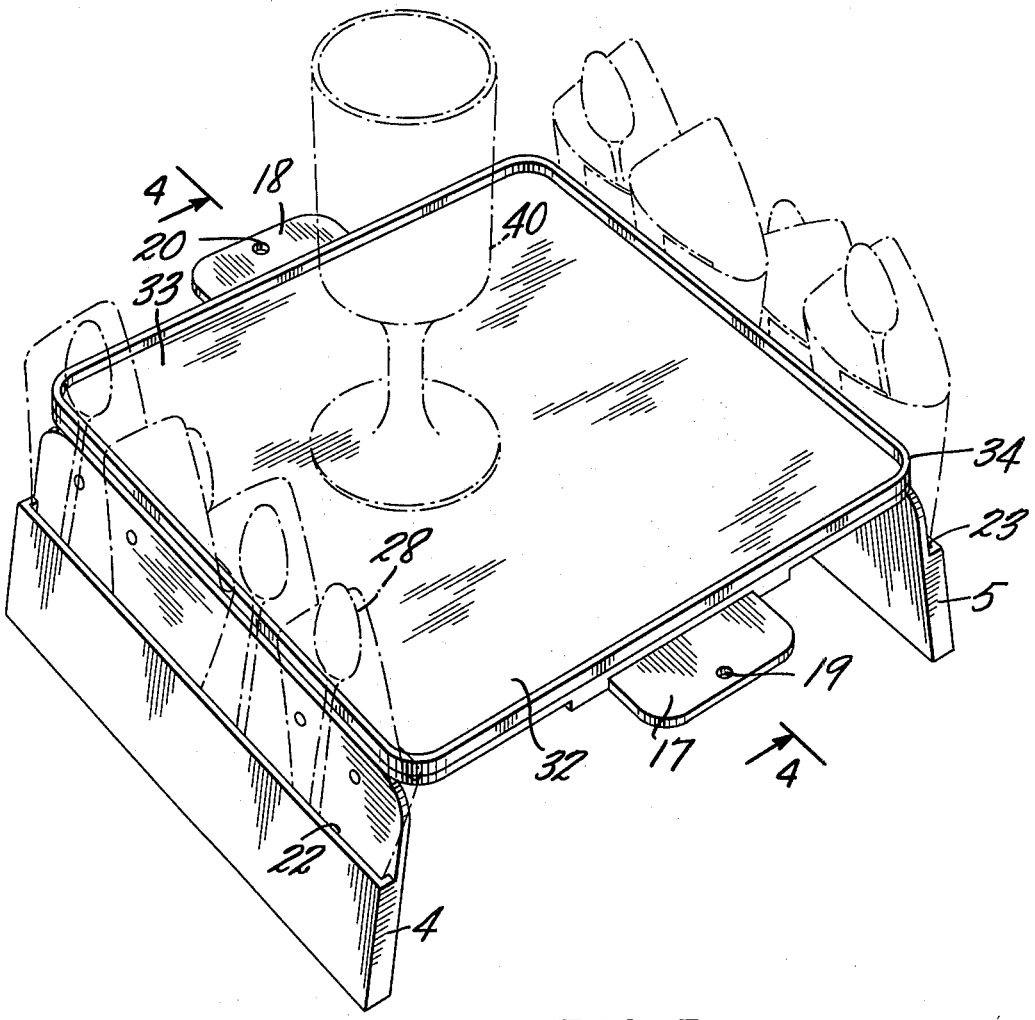
FIG. 3 is a perspective view of a second tray removably mounted on the tray of FIG. 1.
Figure 4:
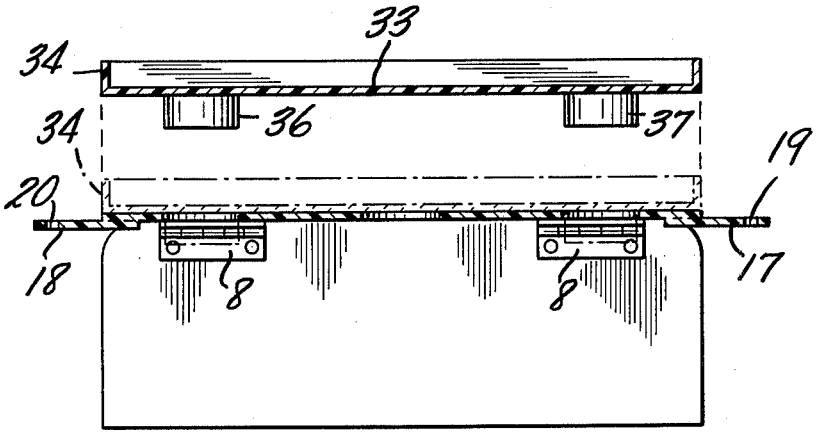
FIG. 4 is a section view taken along section line 4 — 4 of FIG. 3.

The tray is used in the usual manner for serving the articles carried thereon in the holes. The legs 4, 5 are provided with elongated slots 22, 23 defining pockets therein for receiving napkins 26 and silverware 28 as illustrated in FIGS. 1 and 3 for dispensing or serving along with the food articles served on the tray.

Figure 5:
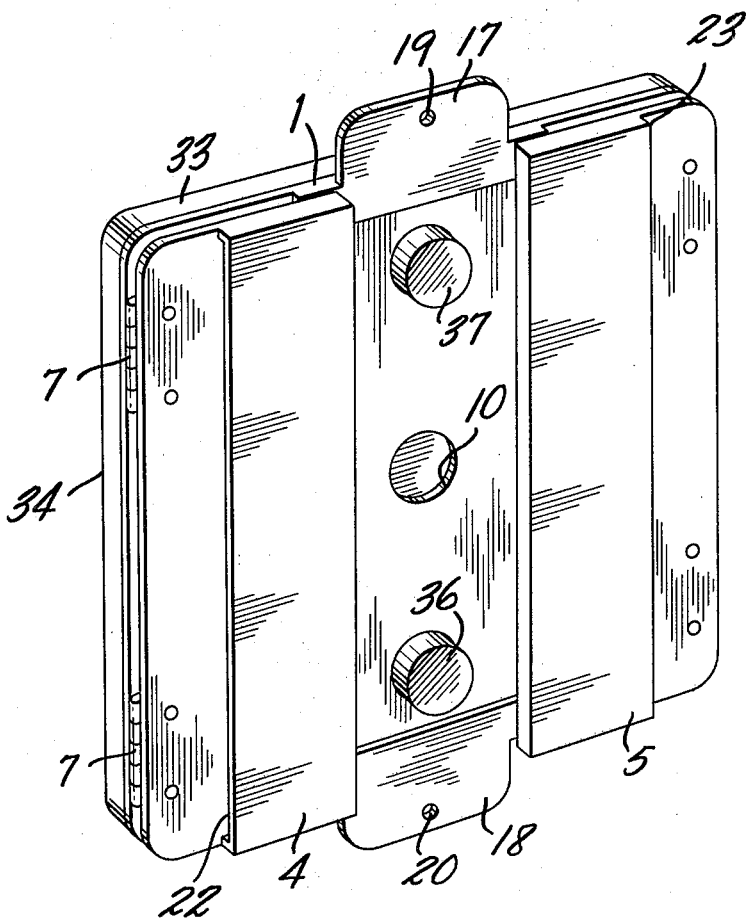
FIG. 5 is a bottom elevation view of the combined trays illustrated with the legs thereof in a folded condition.

The tray is illustrated in its use as a stand in FIG. 1 and in a folded condition in FIG. 5. The hinges are preferably constructed so that when used as a conventional tray the legs remain in a folded condition until extended. However, it is apparent that the tray is transportable and can be used as a tray with the legs extended and set down on the legs as a stand when desired.

A second tray 32 constructed with a flat or planar receptacle 33 and raised edges 34 is provided with two spaced locating lugs 36, 37 on the underside of the receptacle 33 dimensioned to fit corresponding aligned holes on the first-described tray 1. The tray 32 is positionable overlying the receptacle for selectively converting it to a conventional tray assembly as illustrated in FIG. 3 for transporting articles such as foods, glasses and goblets 40 and the like thereon. The legs of the tray 1 can convert both trays to a stand as before described and provide for service of napkins and silverware therefrom. The locating lugs provide for a secure assembly and allow disassembly of the trays.

The trays may be constructed from wood, plywood or rigid plastic materials which can be molded or formed. Although the legs 4, 5 are illustrated as being hinged onto the tray 1 it is apparent that the legs can be connected through a flexible material or made integral with the tray receptacle 2 by use of a flexible plastic connection therebetween.

I claim:

1. Two separable and portable trays usable individually and jointly comprising, a first tray having a flat receptacle having a plurality of holes therein for receiving articles in said holes for transport and serving the articles therefrom, said first tray having legs hinged on the flat receptacle and positionable in a folded position against an underside surface and positionable in an extended depending position for converting said first tray to a stand, hinge means for hinging the legs individually on said first flat receptacle, and a second flat tray usable independently of said first tray and jointly therewith, said second flat tray having a flat receptacle free of holes and having raised edges and locating projections on an underside thereof received in corresponding ones of said holes of said first tray for locating and releasably mounting the second tray on the first tray receptacle to convert said first tray into a flat tray free of holes for transporting articles thereon.

2. A tray according to claim 1, in which said plurality of holes are aligned and disposed in an area on the first flat tray between the legs in a folded condition, and said projections extend through said plurality of holes without being impeded by said legs in a folded condition.

3. The combination according to claim 1, in which said legs each have a slot on an outward side thereof each defining a pocket for receiving napkins and silverware therein for dispensing of the napkins and silverware when serving articles on the tray, and said holes being dimensioned for receiving ice cream cones therein.

* * * * *